US006712645B1

(12) United States Patent
Chou

(10) Patent No.: US 6,712,645 B1
(45) Date of Patent: Mar. 30, 2004

(54) CABLE FIXTURE OF COAXIAL CONNECTOR

(75) Inventor: Shih-Lung Chou, Hsin Tien (TW)

(73) Assignee: Input Output Precise Corporation, Taipei Hsien (TW)

( * ) Notice: Subject to any disclaimer, the term of this patent is extended or adjusted under 35 U.S.C. 154(b) by 0 days.

(21) Appl. No.: 10/419,739

(22) Filed: Apr. 22, 2003

(51) Int. Cl.[7] ..... H01R 9/05
(52) U.S. Cl. ..... 439/582
(58) Field of Search ..... 439/581, 585, 439/394, 63, 582

(56) References Cited

U.S. PATENT DOCUMENTS 5,263,877 A * 11/1993 Mitani ..... 439/585
5,879,190 A * 3/1999 Maruyama et al. ..... 439/582
6,503,100 B2 * 1/2003 Yamane ..... 439/582
6,508,668 B1 * 1/2003 Yamane ..... 439/582

* cited by examiner

*Primary Examiner*—Tho D. Ta
*Assistant Examiner*—James R. Harvey
(74) *Attorney, Agent, or Firm*—Bacon & Thomas, PLLC

(57) ABSTRACT

The present invention discloses a cable fixture for a coaxial connector, and the fixture comprises a metal housing having a hollow cylindrical section, and said cylindrical section at one end has an external cover and an arc-shape lower cover at the other end; the area of said external cover is larger than that of said lower cover such that when an insulator is placed in the cylindrical section, and a cable with terminals are placed on the lower cover, the external cover is bendable to cover cylindrical section, while the upper section covering the cable. Then, the external cover is bent downward to fix onto the cylindrical section, enabling the upper cover and the lower cover to tightly wrap onto the cable.

4 Claims, 5 Drawing Sheets

CABLE FIXTURE OF COAXIAL CONNECTOR

BACKGROUND OF THE INVENTION

1. Field of the Invention

The present invention relates to a cable connector, more particularly to a cable fixture of a coaxial connector that prevents the cable from being detached or broken while unplugging the connector.

2. Description of the Related Art

In a general wireless network device, a certain distance is kept between the transmitting circuit and the receiving circuit to avoid the interference between the transmitting signal and the receiving signal that may deteriorate the signals, and a coaxial cable is used for connecting the transmitting circuit and the receiving circuit.

Please refer to FIG. 1, A connector 11 disposed on both ends of an coaxial cable 10 is individually plugged into the sockets of the transmission circuit and the receiving circuit, such that the transmission circuit and the receiving circuit are electrically coupled, and said connector 11 comprises a metal housing 13, an insulator 15, and a contact terminal 16 at one end of the coaxial cable 10, wherein said metal housing 13 has a hollow cylindrical section 131; said cylindrical section 131 at one end has a covering section 133; said covering section 133 has an area larger than that of the cylindrical section 131; a wing section 135 is extended outwardly from each side of the metal housing 13; said covering section 133 has a wrapping section 136 corresponding to another end of the cylindrical section 131; said wrapping section has a plurality of plates symmetrically arranged and disposed thereon; said insulator 15 at a position proximate the center has a penetrating hole 151 for installing the contact terminal 16, and at one end having an open groove 153 for accommodating the coaxial cable 10; said insulator 15 is disposed in said cylindrical section 131 such that when said coaxial cable 10 and contact terminal 16 are installed onto the open groove 153 and the penetrating hole 151 respectively, said covering section 133 is bendable to cover the covering section 133 on the top surface of the cylindrical section 131, while the wrapping section 136 covers the coaxial cable 10, and then a wing section 135 of the covering section 133 is bent downward, and the plate member of the wrapping section 136 is bent downward to fix the covering section 133 onto the cylindrical section 131, and in the meantime, the plate of the wrapping section 136 wraps the coaxial cable 10 and fixes the coaxial cable onto the connector 11.

However, when the connector 11 is unplugged, the stress pulling the connector 11 may easily cause the coaxial cable to separate from the connector 11 or break between the plates of the wrapping section 136, since the coaxial cable 10 only relies on the plates of the wrapping section 136 to wrap the cable.

SUMMARY OF THE INVENTION

The primary objective of the present invention is to provide a cable fixture for a coaxial connector, and the fixture comprises a metal housing, said housing having a hollow cylindrical section, and said cylindrical section at one end has an external cover and a circular arc lower cover at the other end; the area of said external cover is larger than that of said lower cover such that when an insulator is placed in the cylindrical section, and a cable with terminals are placed on the lower cover, the external cover is bendable to cover cylindrical section, while the upper section covering the cable. Then, wing sections extended from each side of the external cover is bent downward to press on the upper cover and fix the external cover onto the cylindrical section, and fix the upper cover onto the lower cover. By the arrangement of tightly wrapping the cable with the upper and lower covers, the cable will not come off from the upper cover or break when the connector is unplugged.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
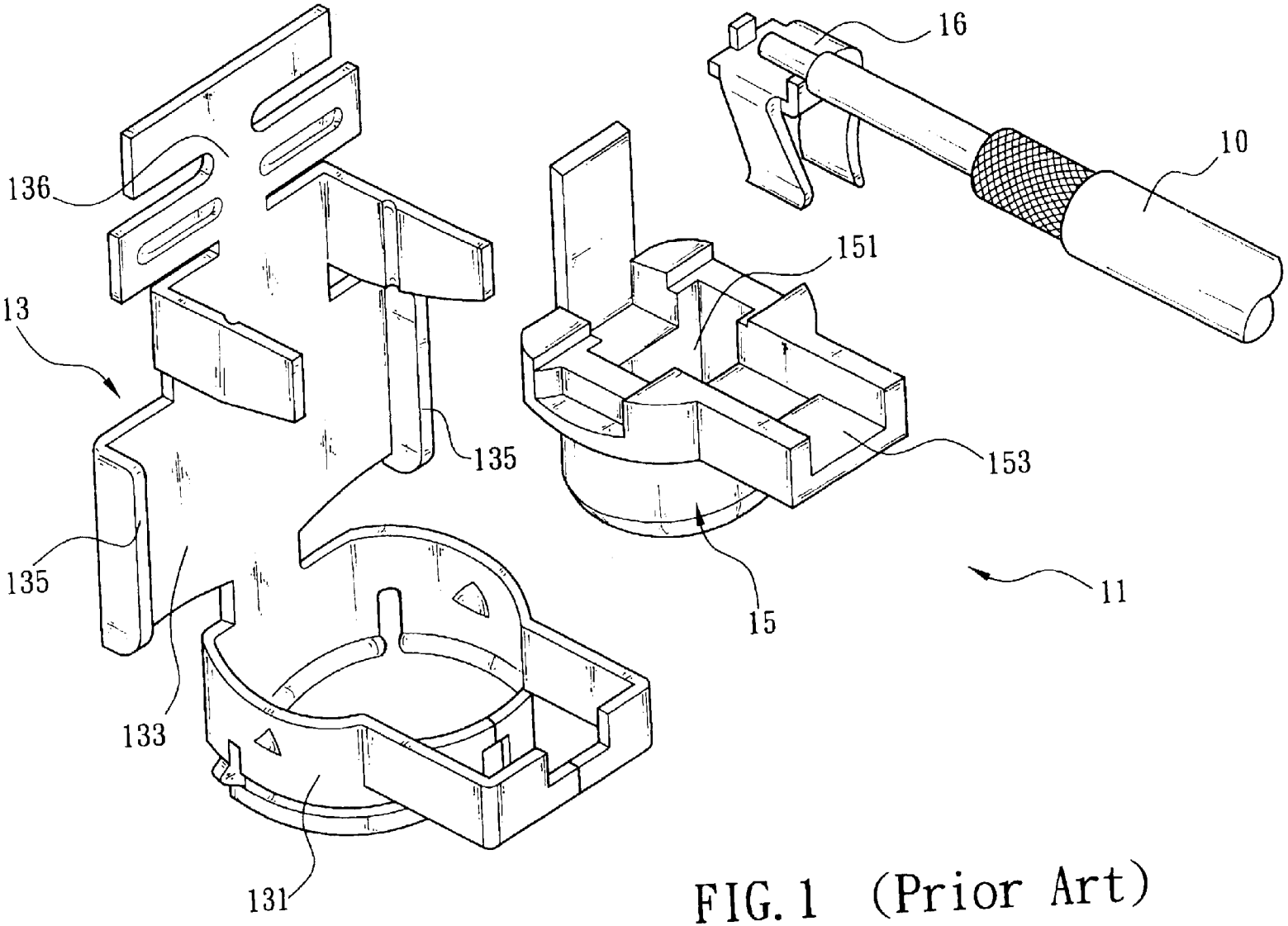
FIG. 1 (Prior Art)
FIG. 1 is a perspective diagram of the disassembled parts of a prior art.
Figure 2:
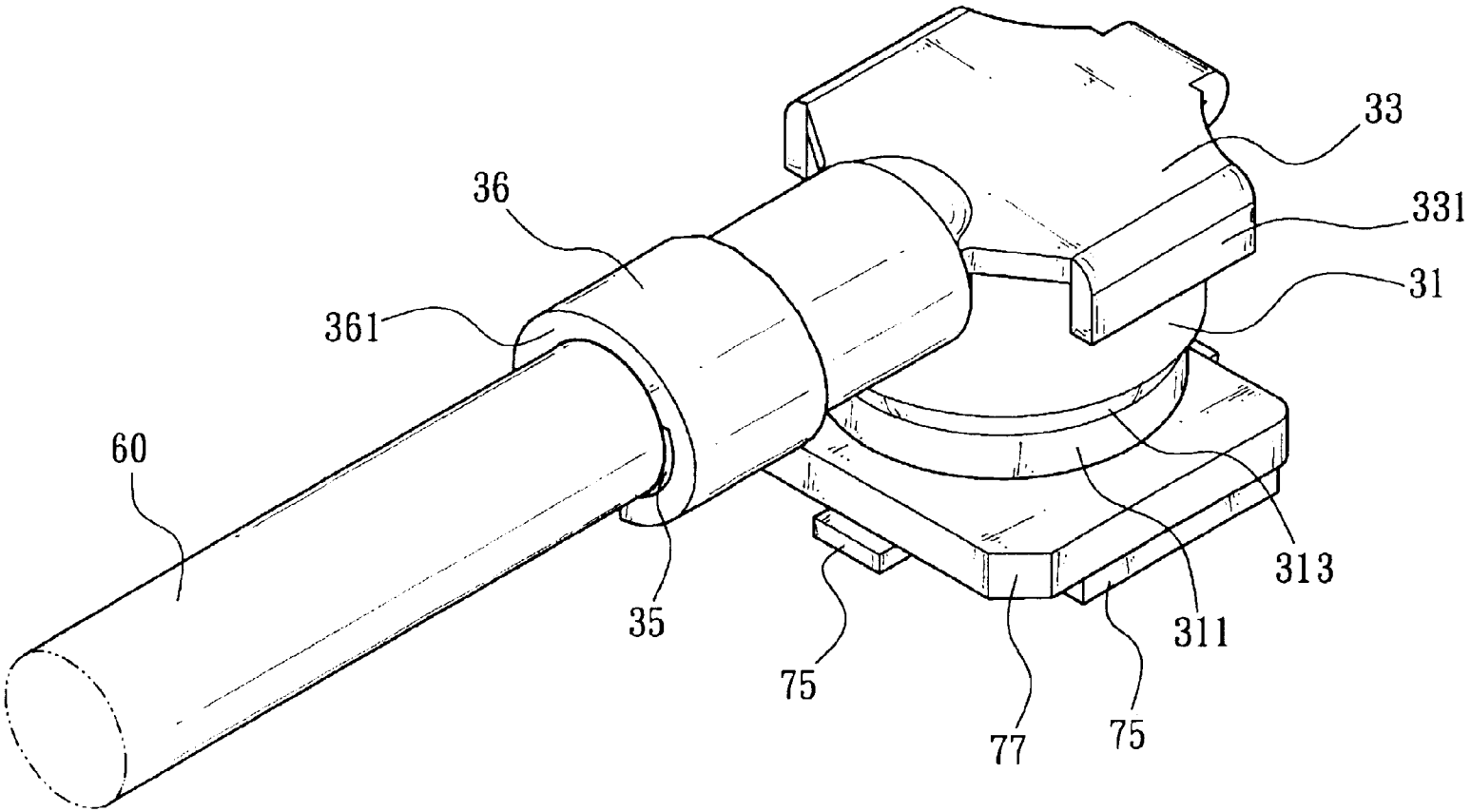
FIG. 2 is a perspective diagram of the present invention.
Figure 3:
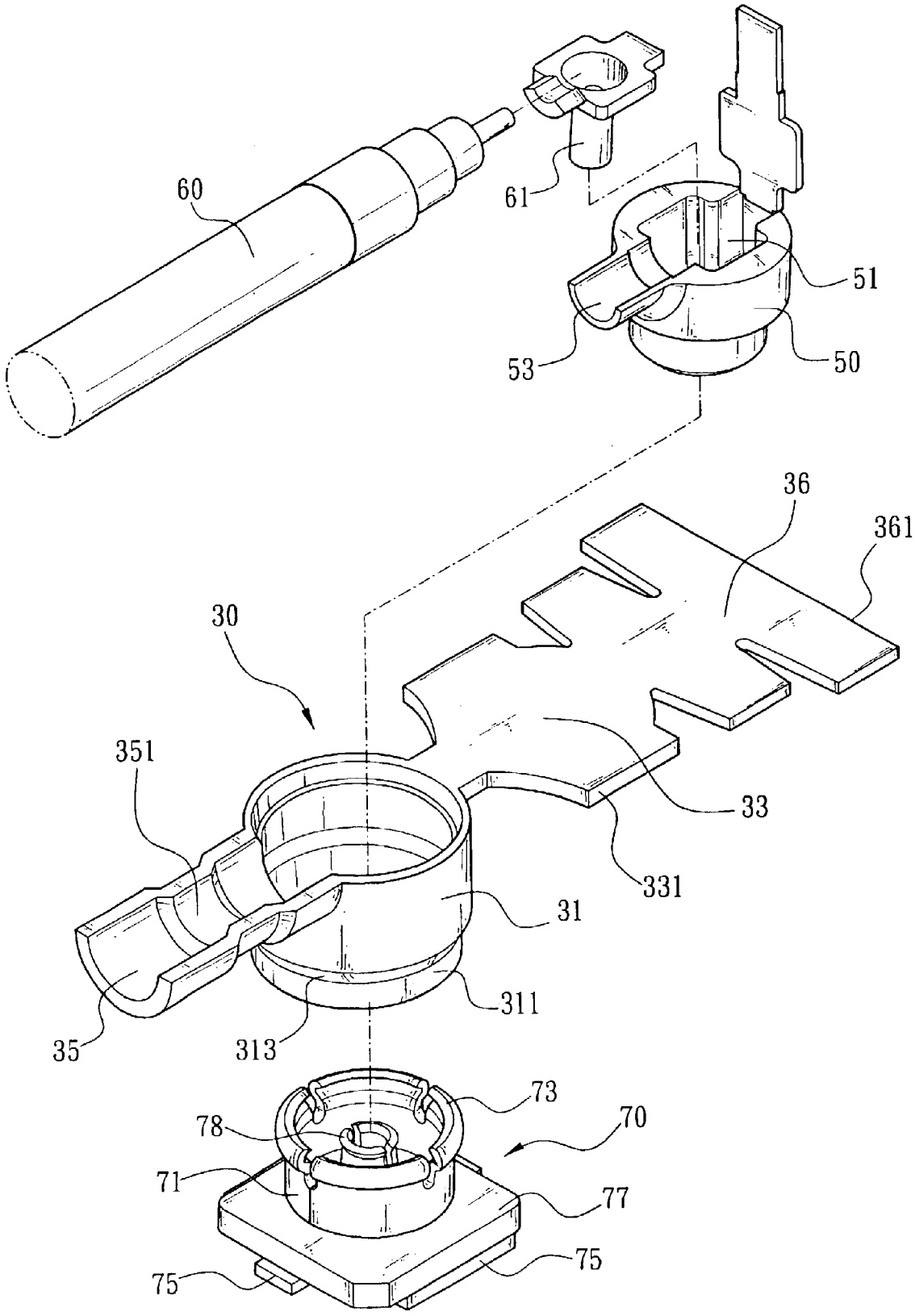
FIG. 3 is a perspective diagram of the disassembled parts of the present invention.

Please refer to FIGS. 2 and 3 for the cable fixture for coaxial connector according to this invention, and said connector formed by sheet drawing, comprises a metal housing 30, said housing 30 being integrally formed and having a hollow cylindrical section 31 such that an insertion end 311 with an external diameter slightly smaller than the cylindrical section 31 being disposed at the bottom of the cylindrical section 31, and an inwardly concave shoulder section 313 being defined between the top of cylindrical section 31 and the insertion end 311; said cylindrical section 31 at one end having an external cover 33, and an arc-shape lower cover 35 at the other end; the area of said external cover 33 being larger than that of said cylindrical section 31 and having a wing section 331 extended outwardly from each side thereof for fixing onto the corresponding side of the cylindrical section 31; an inwardly concave recession 351 being disposed at the center of said lower cover 35; an upper cover 36 being disposed at the other end of said external cover 33 corresponding to the cylindrical section 31 and having a wrapping section 361 extended from each side thereof, the area of said upper cover 36 being larger than that of the lower cover 35, and the area at one end of the adjacent external cover 33 being smaller than the area at the other end.

By means of the foregoing components, when an insulator 50 is placed in the cylindrical section 31, and a cable 60 with a terminal 61 is placed onto the lower cover 35, the external cover 33 is bendable to cover the cylindrical section 31 while the upper cover 36 covers the coaxial cable 60, and then said wing sections 331 extended from each side of the external cover 33 are bent downward and presses down on both sides of the cylindrical section 31 to fix the external cover 33 on the cylindrical section 31 and wrap the upper cover 36 onto the lower cover 35 by said wrapping sections 361 extended from each side thereof. Therefore, the cable 60 is tightly wrapped by the upper and lower covers 36, 35 and the recession 351 of the lower cover 35, so that the cable 60 will not fall off from the upper cover 36 or break.

Figure 4:
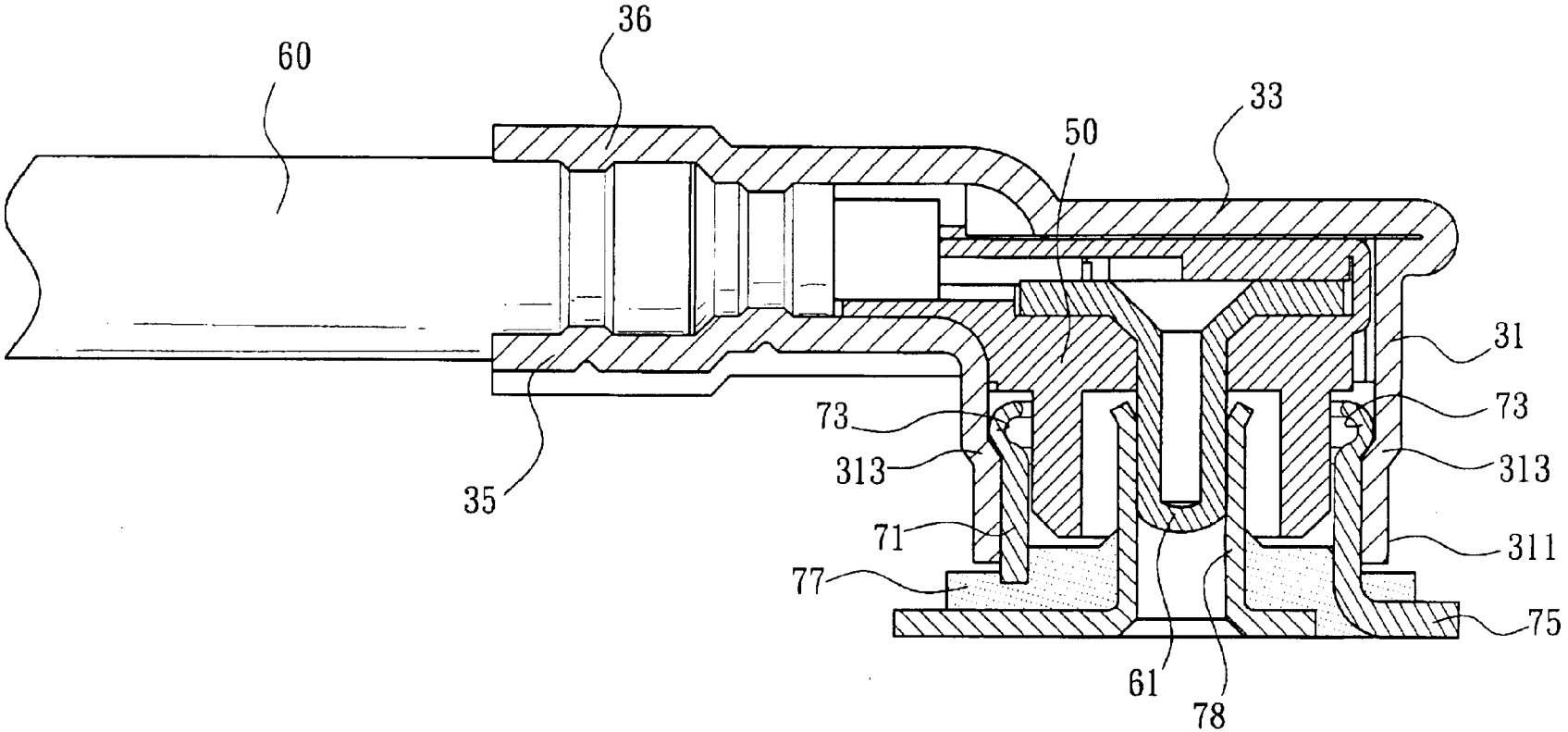
FIG. 4 is a cross-sectional diagram of the present invention.

Please refer to FIGS. 3 and 4 for the present invention, wherein said terminal 61 is integrally made by sheet drawing, and soldered to one end of said terminal 61; a penetrating hole 51 disposed at the center of the insulator 50 for accommodating the terminal 61 and having an open groove 53 at one end for accommodating the cable 60; said terminal 61 is installed into the penetrating hole 51 and said cable 60 is installed onto the groove 53, said insulator 50 is installed in the cylindrical section 31.

Please refer to FIGS. 3 and 4 for the present invention, wherein said connector is inserted into the slot 70 of a circuit board so that the circuit of the circuit board and the cable 60 are electrically coupled; said slot 70 has a cylindrical metal base 71, and said base 71 at its top has a plurality of circular arc and outwardly protruded contact sections 73, and at its bottom has a plurality of outwardly extended guiding plates 75, and said guiding plates 75 are soldered to the circuit of the circuit board; said base 71 has an insulator 77 and a pin 78, so that when the connector is plugged into said slot 70, the cylindrical section 31 of said connector will coupled onto the base 71, and the shoulder section 313 of the cylindrical section 31 presses against the contact section 73 of the base 71 such that the connector will not easily fall apart from the slot 70.

Please refer to FIGS. 3 and 4 for the present invention, wherein the cable 60 is a coaxial cable, and the core conductive wire and terminal 61 are soldered together.

In the present invention, the circuit board could be a wireless network card, and the receiving signal circuit and transmission signal circuit of said wireless network card are kept in a certain distance apart to avoid the interference between the transmission signal and the receiving signal that may deteriorate the signals. The receiving signal circuit and transmission signal circuit are connected through the cable 60 for the electric connection.

In the present invention, the circuit board could be the circuit board of a mobile phone; the receiving signal circuit and the transmission signal circuit are kept at a specific distance apart to avoid the interference between the transmission signal and the receiving signal that may deteriorate the signals. The receiving signal circuit and transmission signal circuit are connected through the cable 60 for the electric connection.

Figure 5:
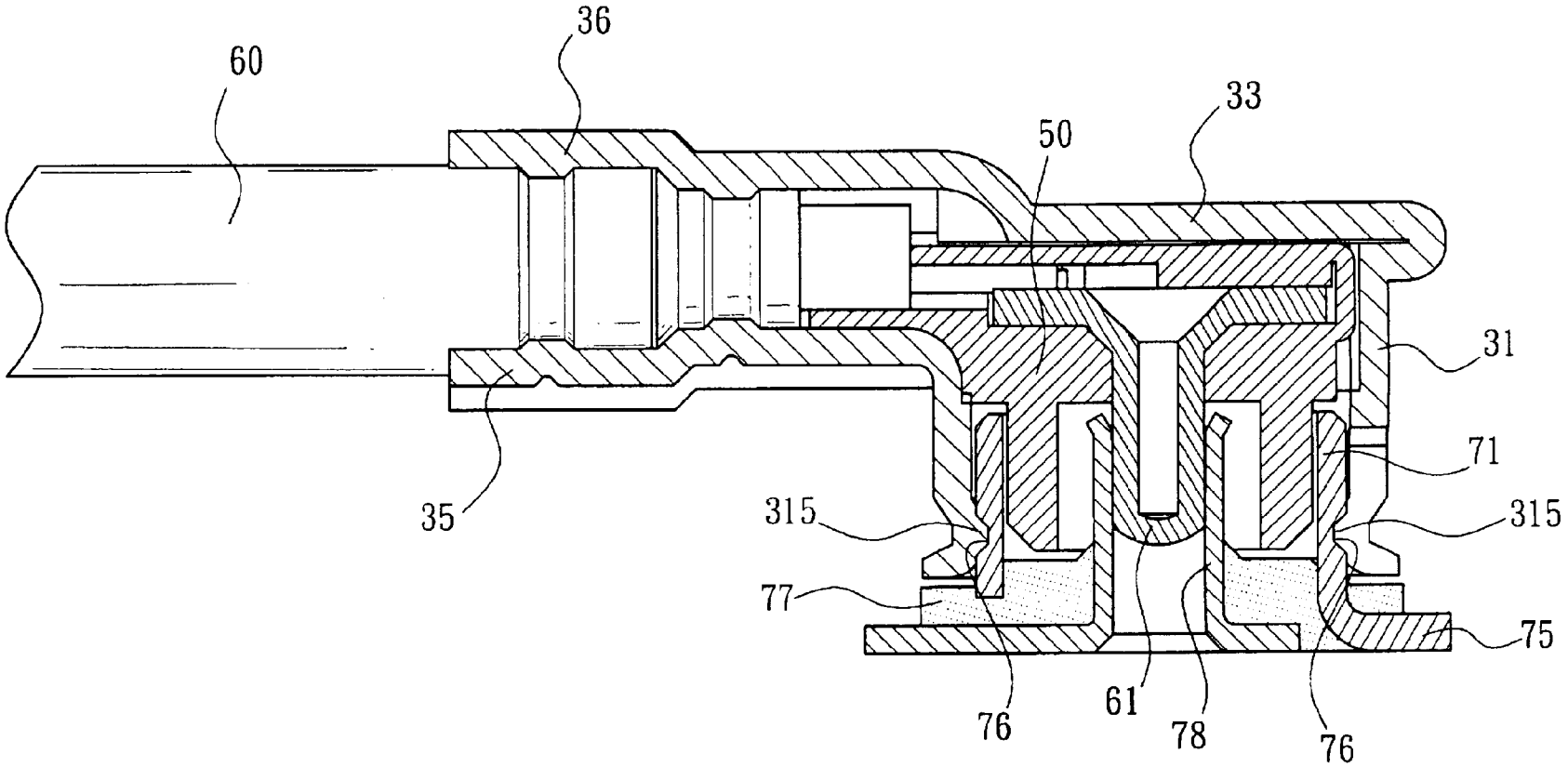
FIG. 5 is a cross-sectional diagram of another embodiment of the present invention.

Please refer to FIG. 5 for another preferred embodiment of the present invention. Wherein the cylindrical section 31 at its bottom has a plurality of circular arc and inwardly concave contact ends 315; a recession 76 is disposed on the base of the slot 70 at a position corresponsive to the contact end 315, so that when the connector is plugged into the slot 70, the cylindrical section 31 of the connector is coupled onto the base 71, and latched into the recession 76 through the contract end 315, such that the connector will not fall apart from the slot 70 easily.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. A cable fixture for coaxial connector, comprising:

a metal housing, being integrally made by sheet drawing, and having a hollow cylindrical section, such that an insertion end with an external diameter slightly smaller than that of said cylindrical section being disposed at the bottom of said cylindrical section, and an inwardly concave shoulder section being defined between the top of said cylindrical section and said insertion end 311; said cylindrical section having an external cover at one end, and an arc-shape lower cover at the other end; the area of said external cover being larger than that of said cylindrical section, and having a wing section outwardly extended from each side thereof for fixing onto both sides of said cylindrical section; an inwardly concave recession being disposed at the center of said lower cover; an upper cover being disposed at the other end of said external cover corresponding to said cylindrical section and having a wrapping section extended from each side thereof; the area of said upper cover being larger than that of the lower cover, and the area of one end of the adjacent external cover being smaller than the area of the other end;

by means of the foregoing components, when an insulator being placed in said cylindrical section and a cable with a terminal being placed onto the lower cover, the external cover being bendable to cover said cylindrical section while the upper cover covering the coaxial cable, and then said wing sections of the external cover being bent downward and pressing down on both sides of the upper cover to fix the external cover on said cylindrical section and wrap the upper cover onto the lower cover by said wrapping sections; thereby the cable being tightly wrapped by the upper and lower covers and the recession of the lower cover, and thus preventing the cable from falling off from the upper cover or break.

2. The cable fixture for coaxial connector of claim 1, wherein said terminal is soldered to one end of said cable.

3. The cable fixture for coaxial connector of claim 1, wherein said connector is inserted into a slot of a circuit board so that the circuit of the circuit board and the cable being electrically coupled; said slot having a cylindrical metal base, and said base at its top having a plurality of circular and outwardly protruded contact sections, and at its bottom having a plurality of outwardly extended guiding plates, and said guiding plates being soldered to the circuit of the circuit board; said base having an insulator and a pin, so that when the connector being plugged into said slot, the cylindrical section of said connector being coupled onto the base, and the shoulder section of said cylindrical section pressing against the contact section of the base such that the connector not easily falling apart from the slot.

4. The cable fixture for coaxial connector of claim 3, wherein said cylinder section at its bottom has a plurality of arc-shape and inwardly concave contact ends, and the base of said slot has a recession at the position corresponsive to said plurality of contact ends, so that when said connector being plugged into the slot, the cylindrical section of said connector being coupled to the base and latched onto said recession through said contact end, and thus the connector not falling off easily from the slot.

* * * * *